US007217010B2

(12) United States Patent
Lin et al.

(10) Patent No.: US 7,217,010 B2
(45) Date of Patent: May 15, 2007

(54) REFLECTOR WITH NEGATIVE FOCAL LENGTH

(75) Inventors: Jian-Shian Lin, Yilan (TW); Hsiu-Chen Hsu, Tainan (TW); Min-Lung Hsieh, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 56 days.

(21) Appl. No.: 11/088,792

(22) Filed: Mar. 25, 2005

(65) Prior Publication Data

US 2006/0139933 A1 Jun. 29, 2006

(30) Foreign Application Priority Data

Dec. 29, 2004 (TW) ..... 93221148 U

(51) Int. Cl.
*F21V 7/00* (2006.01)

(52) U.S. Cl. ..... 362/300; 362/297; 362/305; 362/346; 362/347

(58) Field of Classification Search ..... 362/297, 362/300, 305, 346, 347
See application file for complete search history.

(56) References Cited

U.S. PATENT DOCUMENTS 5,207,495 A * 5/1993 Ahlstone ..... 362/33
5,897,196 A * 4/1999 Soskind et al. ..... 362/507
6,234,645 B1 5/2001 Borner et al. ..... 362/231
6,540,382 B1 * 4/2003 Simon ..... 362/339
6,698,908 B2 * 3/2004 Sitzema et al. ..... 362/328
2005/0129357 A1 * 6/2005 Yang et al. ..... 385/31
2005/0168995 A1 * 8/2005 Kittelmann et al. ..... 362/328

* cited by examiner

*Primary Examiner*—Renee Luebke
*Assistant Examiner*—Jessica McMillan
(74) *Attorney, Agent, or Firm*—Troxell Law Office, PLLC

(57) ABSTRACT

A luminaire with reflector of negative focal length is disclosed, which comprises a light source and a luminaire screen having a reflector of negative focal length, a side screen and a plate; wherein the reflector of negative focal length is capable of reflecting the upward-incident rays emitted from the light source; and the side screen is capable of reflecting the sideward-incident rays emitted from the light source and the reflected rays of the reflector; and the plate being disposed at the lower portion of the luminaire screen beneath the light source has a plurality of micro-structures arranged thereon and is capable of accepting the rays of the downward incident area along with both the reflected rays of the reflector and the side screen so as to diffuse the same for discharging. By the luminaire screen of the invention, the rays emitting from the light source of the luminaire are reflected and directed to a preferred discharging area so as to enable the rays to be discharged out of the luminaire by large angles for reducing glare.

16 Claims, 7 Drawing Sheets

REFLECTOR WITH NEGATIVE FOCAL LENGTH

FIELD OF THE INVENTION

The present invention relates to a reflector with negative focal length, and more particularly, to a reflector with negative focal length adapted for replacing the reflector with positive focal length arranged at the upper area of a common luminaire screen, by which rays emitting from the lamp of the luminaire are reflected and directed to a preferred discharging area so as to enable the rays to be discharge out of the luminaire by large angles for reducing glare, in addition, the height of the luminaire can be reduced.

BACKGROUND OF THE INVENTION

Before the invention of the light bulb, illuminating the world after the sun went down was a messy, arduous, hazardous task. It took a bunch of candles or torches to fully light up a good-sized room, and oil lamps, while fairly effective, tended to leave a residue of soot on anything in their general vicinity. With the invention of light bulb along and as the science of electricity really got going in the mid 1800s, the easy-to-use lighting technology was such an improvement over the old ways that the world never looked back.

Currently, the application of illuminating device can be categorized into two fields. One of which is the construction industry, that includes all sorts of lighting systems adapted for private housing units, commercial buildings, and public transportation systems like highway and railway, and so on, so as to achieve objects of comfort, beautification, and safety; another filed is the commercial goods, that includes all sorts of light source adapted for auto lamps, indoor lightings and consumer electronics, etc. As in the Year 2000, the largest demand for illuminating devices lays in the United State of American. Generally, the demand for illuminating devices is growing in a rapid path following the growth of global economy. Nevertheless, as the environmental awareness also grows with the global economy, it is in great demand to have green lighting systems for enhancing environmental protection and energy conservation.

Please refer to FIG. 1, which is a cross-section of a lighting system disclosed in U.S. Pat. No. 6,234,645, entitled "LED LIGHTING SYSTEM FOR PRODUCING WHIT LIGHT". As seen in FIG. 1, the white lighting system 1 has at least three light-emitting diodes (LEDs) 11 for providing visible light at pre-selected wavelengths. In operation, the white lighting system 1 is provided with at least one fourth light-emitting diode 12 which, emits visible light in a further wavelength region, the maximum of the spectral emission of the fourth light-emitting diode 12 lying in the further wavelength region from 575 to 605 nm. Moreover, the screen 13 is provided on a side facing the LEDs 11, 12 with reflection means 14 which diffusely reflect white light so as to effectively blend the light of the LEDs 11, 12. However, the luminaire structure as disclosed in the U.S. Pat. No. 6,234,645 has low luminaire efficacy since it can not guide and scatter the rays emitted from the light source such that the referring lighting system 1 can not control the distribution of luminous intensity, not to mention the enhancement of luminance efficacy of a source of light while glare still can not be avoid.

In view of the abovementioned shortcomings, it is require to have an improved illuminating device with high luminaire efficacy for the sake of environmental conservation and also capable of reducing glare.

SUMMARY OF THE INVENTION

It is the primary object of the invention to provide a reflector with negative focal length adapted for replacing the reflector with positive focal length arranged at the upper area of a common luminaire screen, by which rays emitting from the lamp of the luminaire are reflected and directed to a preferred discharging area so as to enable the rays to be discharge out of the luminaire by large angles for reducing glare, in addition, the height of the luminaire can be reduced.

It is another object of the invention to provide a luminaire screen with microstructures arranged thereon for light blending, by which LEDs can be employed as the light sources of a luminaire while the luminaire can have good luminous efficacy.

Yet, another object of the invention is to provide a plate having a plurality of microstructures disposed thereon, which is arranged at the lower portion of a luminaire under the light source thereof so as to better diffuse the rays discharging out of the luminaire and thus reducing glare.

To achieve the above objects, the present invention provides a luminaire with reflector of negative focal length which comprises a light source and a luminaire screen having a reflector of negative focal length, a side screen and a plate; wherein the rays emitting from the light source is divided by three area: a upward incident area including the rays incident to the reflector of negative focal length as seen in FIG. 2; a sideward incident area including rays incident to the side screen as seen in FIG. 3; and a downward incident area including rays incident to the plate as seen in FIG. 4; and the reflector of negative focal length is capable of reflecting the rays of upward incident area; and the side screen is capable of reflecting the ray of the sideward incident area and the reflected rays of the reflector; and the plate being disposed at the lower portion of the luminaire screen beneath the light source has a plurality of microstructures arranged thereon and is capable of accepting the rays of the downward incident area along with both the reflected rays of the reflector and the side screen so as to diffuse the same for discharging.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENT

For your esteemed members of reviewing committee to further understand and recognize the fulfilled functions and structural characteristics of the invention, several preferable embodiments cooperating with detailed description are presented as the follows.

The present invention improves structure of the screen of a common luminaire and the surface finishing thereof such that the transmission direction of the rays emitting by the luminaire can be changed. Further, the manufacturing cost of the improved luminaire is not aversely affected, but can provide better illumination for exterior lighting, wide-angle lighting and preferred anti-glare function with reduction of the height of the luminaire.

Figure 5:
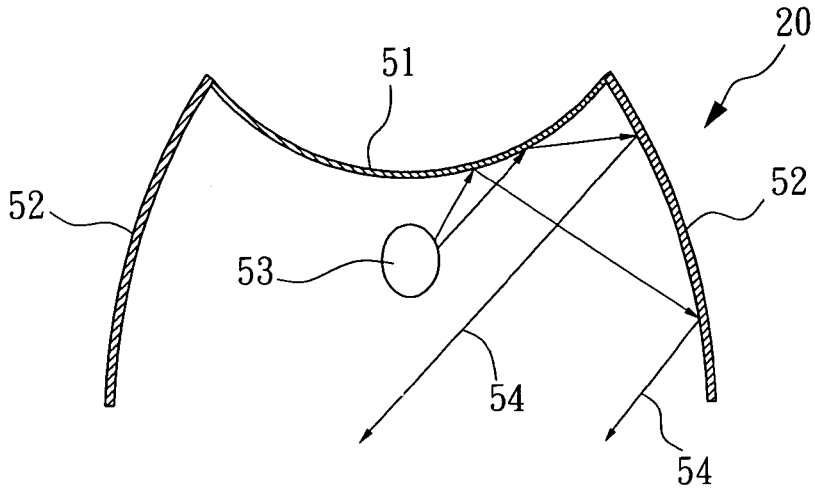
FIG. 5 shows a luminaire with reflector of negative focal length according to a first embodiment of the invention.

Please refer to FIG. 5, which shows a luminaire with reflector of negative focal length according to a first embodiment of the invention. In FIG. 5, the top of the luminaire screen 20 is a reflector of single negative focal length 51, such that the cross section of the luminaire screen 20 is a concavity with a side screen 52 connecting to the edge of the reflector 51. By the luminaire screen 20 of FIG. 5, the upward-incident rays emitting from a light source 53 are first reflected to the side screen 52 by the reflector 51, and then are further reflected such that a plurality of discharging rays 54 are generated. It is noted that the discharging rays 54 are discharge out of the luminaire by large angles for reducing glare. In addition, the height of the luminaire can be reduced. However, the luminaire with reflector of single negative focal length can be further improved.

Figure 6:
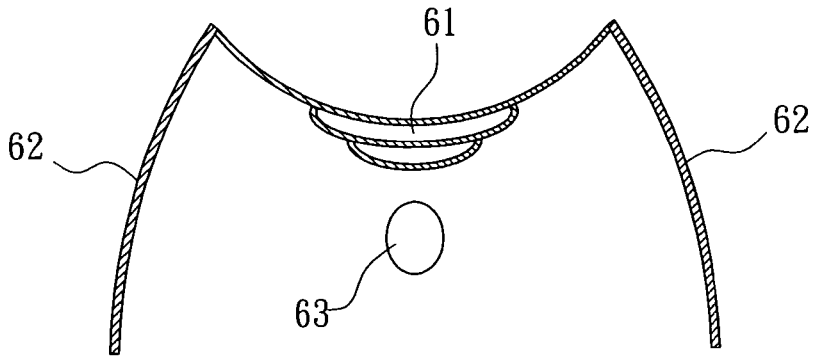
FIG. 6 shows a luminaire with reflector of negative focal length according to a second embodiment of the invention.

In FIG. 6, which is a luminaire with reflector of negative focal length according to a second embodiment of the invention, the top of the luminaire screen is a reflector of multiple negative focal lengths 61. As seen in FIG. 6, the reflector 61 is a combination of a plurality of concentric concavities shrinking downwardly in diameter and the cross section thereof shows that a side screen 62 is connected to the edge of the reflector 61. By the reflector of multiple negative focal lengths 61, the upward-incident rays emitting from a light source 63 are reflected to the side screen 62 in a diverse manner. However, the manufacture of the luminaire of FIG. 6 is costly and complicated such that it is not feasible in reality.

Figure 1:
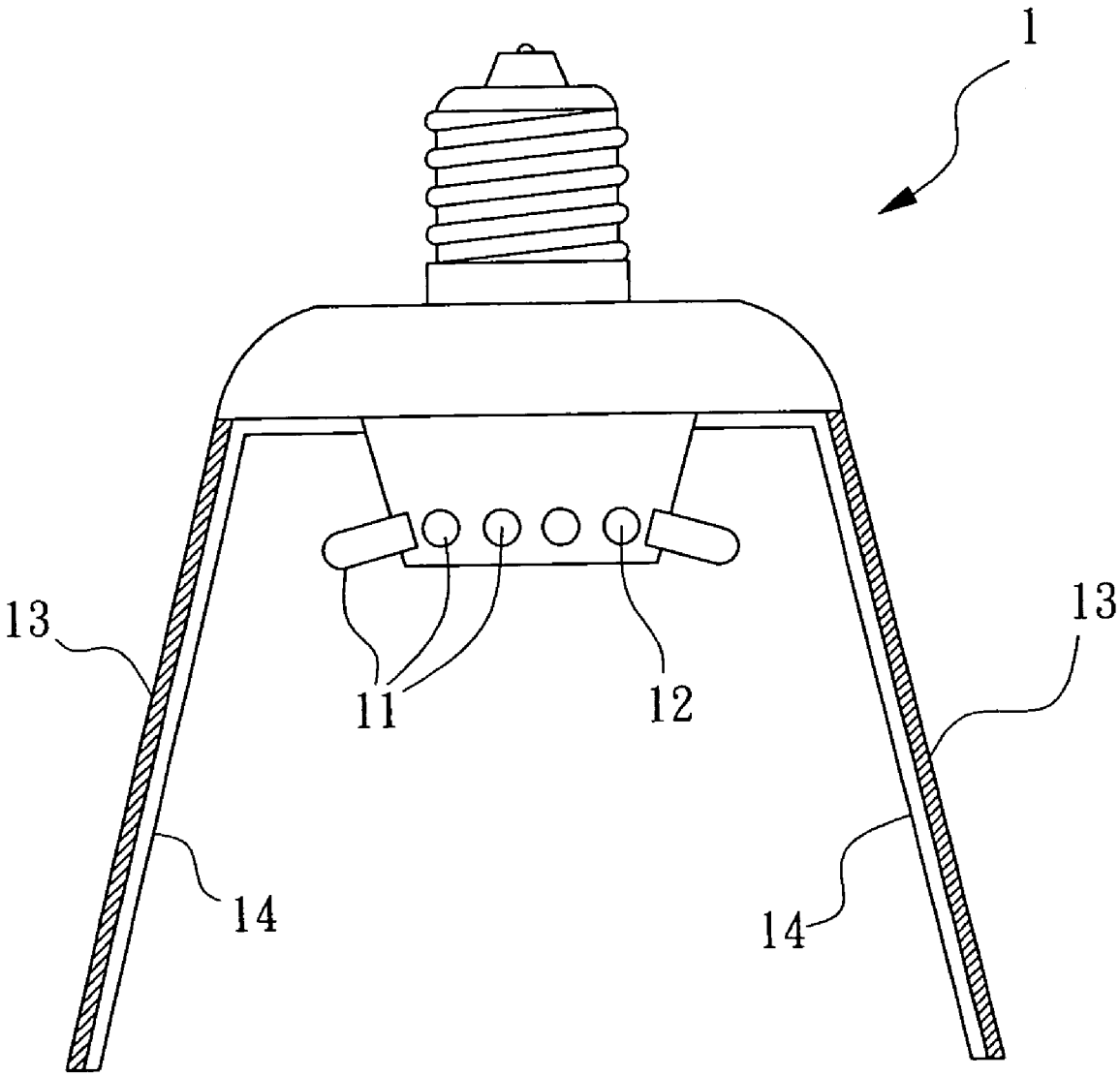
FIG. 1 (PRIOR ART)
FIG. 1 is a cross-section of a lighting system disclosed in U.S. Pat. No. 6,234,645.
Figure 2:
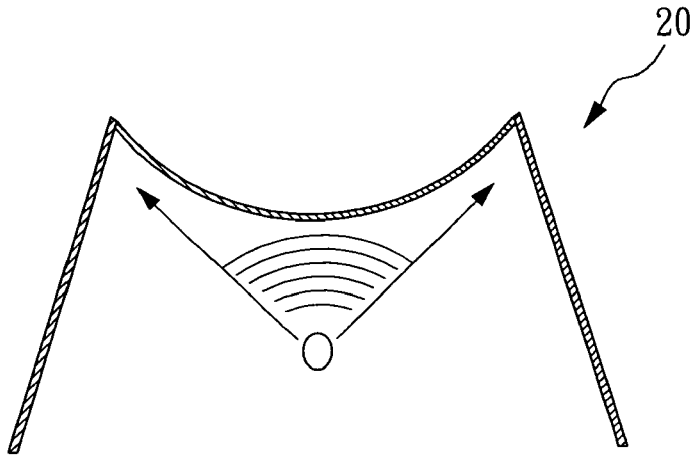
FIG. 2 is a schematic illustration showing a upward incident area of rays emitting from a light source of the present invention.
Figure 3:
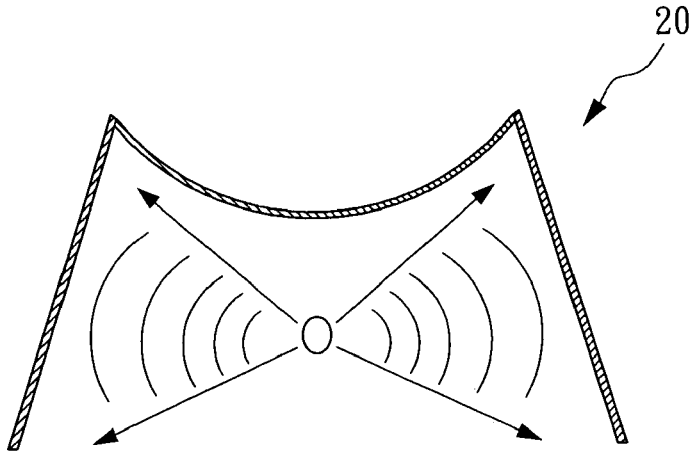
FIG. 3 is a schematic illustration showing a sideward incident area of rays emitting from a light source of the present invention.
Figure 4:
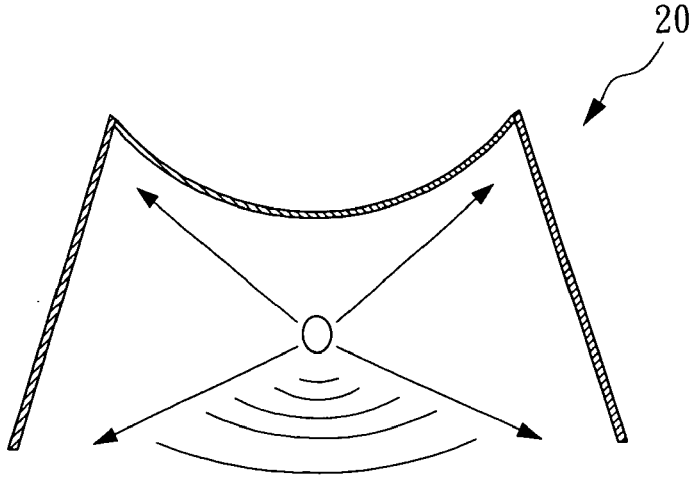
FIG. 4 is a schematic illustration showing a downward incident area of rays emitting from a light source of the present invention.
Figure 7:
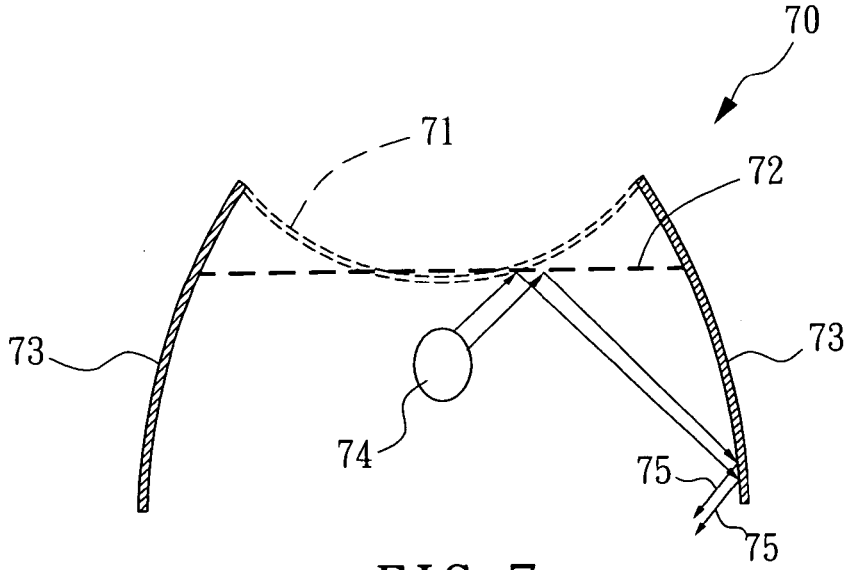
FIG. 7 shows a luminaire with reflector of negative focal length according to a third embodiment of the invention.

For the third embodiment of the invention shown in FIG. 7, the reflector with negative focal length 71 similar to that shown is FIG. 2 is replaced by a planar reflector 72 while a side screen 73 is attached to the edge of the planar reflector 72 similar to that of FIG. 2. By using the luminaire screen of FIG. 7, the space occupied by the luminaire can be reduced since the volume of the luminaire screen is reduced.

For enabling the planar reflector 72 to have the same function as the reflector with negative focal length 71, a Fresnel lens must be formed on the surface of the planar reflector 72 that is composed of a plurality of microstructures forming a regular formation like sawtooth or an irregular formation. Therefore, by the Fresnel lens formed on the planar reflector 72, the upward-incident rays emitting from a light source 73 are reflected to the side screen 73 by the reflector 72, and then are further reflected so as to generate a plurality of discharging rays 75 similar to those shown in FIG. 5.

Figure 8:
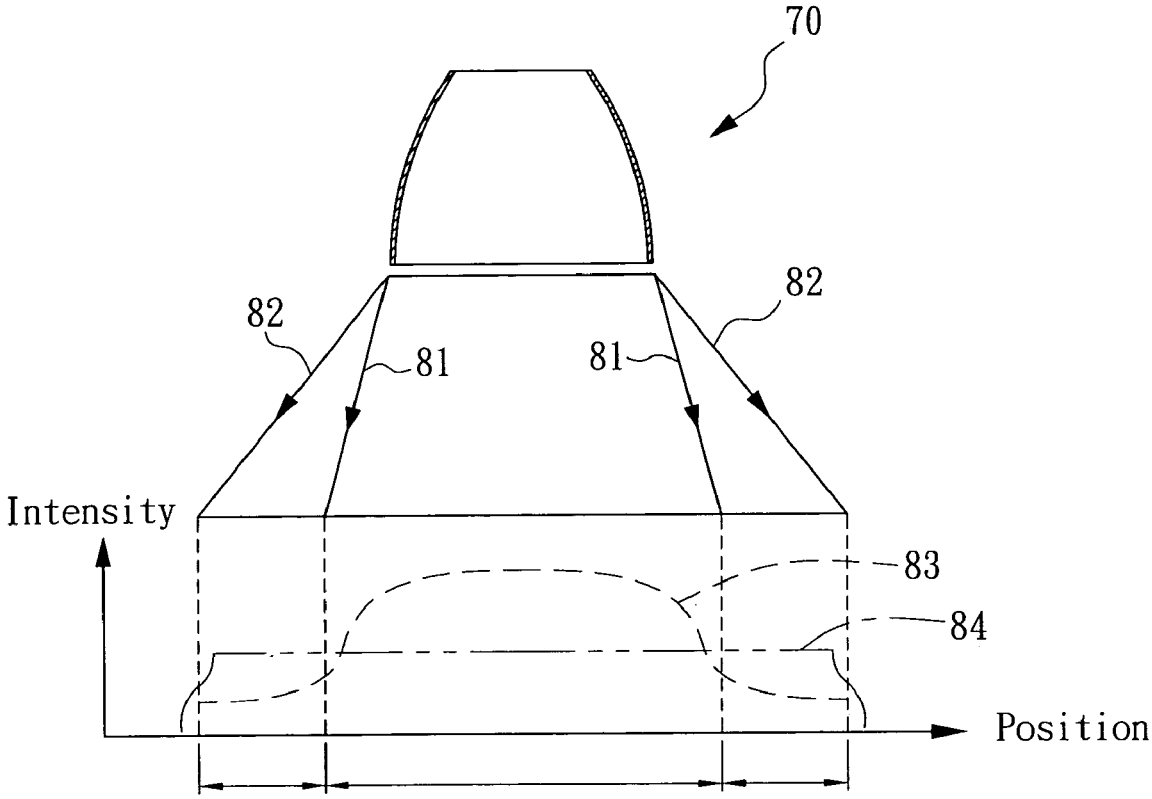
FIG. 8 is a profile of light intensity generated by a luminaire with reflector of negative focal length of the invention for glare reduction.

Please refer to FIG. 8, which a profile of light intensity generated by a luminaire with reflector of negative focal length of the invention for glare reduction. As seen in FIG. 8, the outlook of the luminaire screen 70 with planar reflector is simple and compact, and the discharging angle of a luminaire with planar reflector defined by the two arrows 82 is larger than that of a luminaire without planar reflector, which is defined by the two arrows 81. The luminaire with small discharging angle is pone to generate glare that causes eye-fatigue since the light intensity of the illuminating area of the luminaire directly under the luminaire screen is far larger than that of the off-center area of the luminaire screen. By virtue of this, the use of the planar reflector is intended to enable the light intensity of the illuminating area of the luminaire directly under the luminaire screen to be almost equal to that of the off-center area of the luminaire screen and is reduce to the range acceptable by human eye as illustrated by the profile of light intensity 84 seen in FIG. 8 such that the phenomenon of eye-fatigue can be avoid after working for long hours under the illumination of the luminaire with planar reflector.

Figure 9:
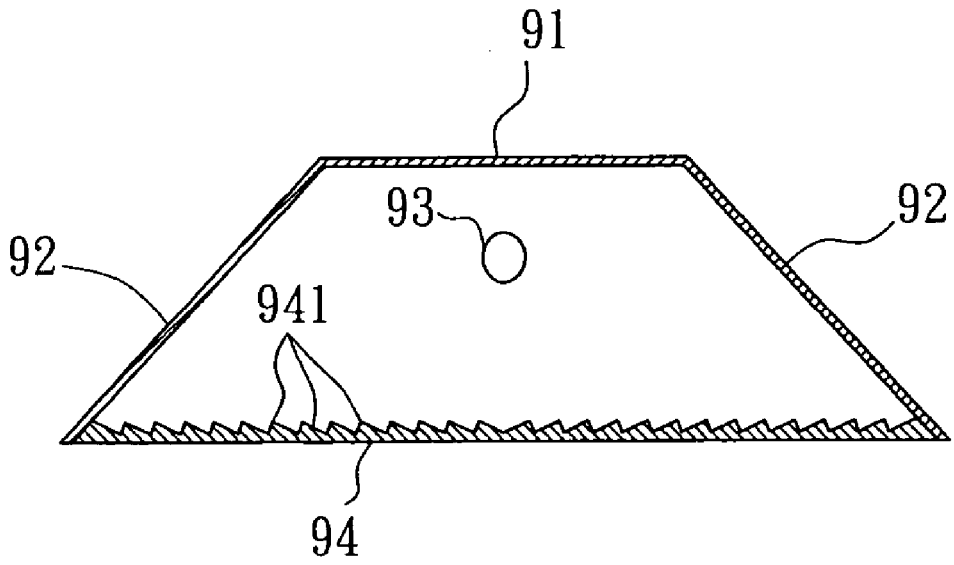
FIG. 9 is a cross-section of a plate being disposed at the lower portion of the luminaire screen beneath the light source according to the present invention.

FIG. 9 shows a cross-section of a plate 94 being disposed at the lower portion of the luminaire screen beneath the light source 93, the luminaire screen comprising a planar reflector 91 a side screen 92. As seen in FIG. 9, a plurality of microstructures 941 are disposed on the plate whose formation can be of the shape of sawtooth, or each can be a diffuse point of a shape selected from the group consisting of diamond, sphere, column, and irregular shapes. Moreover, the plural microstructures disposed on the plate are formed by a manner selected from the group consisting of apart from one another by an equal interval and apart from one another by different intervals, so as to regulate the amount of rays discharging from the plate 94.

Figure 10:
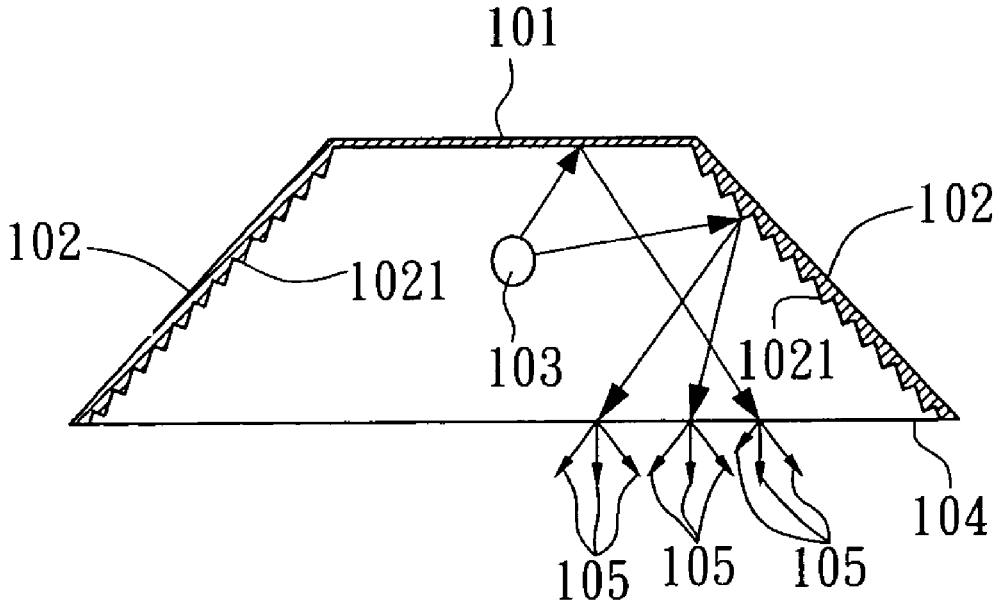
FIG. 10 is a cross-section showing a plurality of microstructures being arranged on the side screen of a luminaire with reflector of negative focal length according to the present invention.

FIG. 10 shows a cross-section of a plurality of microstructures 1021 being arranged on the side screen 102 of a luminaire with planar reflector 101 according to the present invention, the luminaire further comprising a light source 103 and a plate 104. As seen in FIG. 10, a plurality of microstructures 1021 are disposed on the side screen 102 that each can be a diffuse point of a shape selected from the group consisting of diamond, sphere, column, and irregular shapes. Moreover, the plural microstructures 1021 disposed on the side screen 102 are formed by a manner selected from the group consisting of apart from one another by an equal interval and apart from one another by different intervals, so as to enable the discharging of evenly distributed discharging light 105 for preventing glare as well as reducing the volume of the luminaire.

Figure 11:
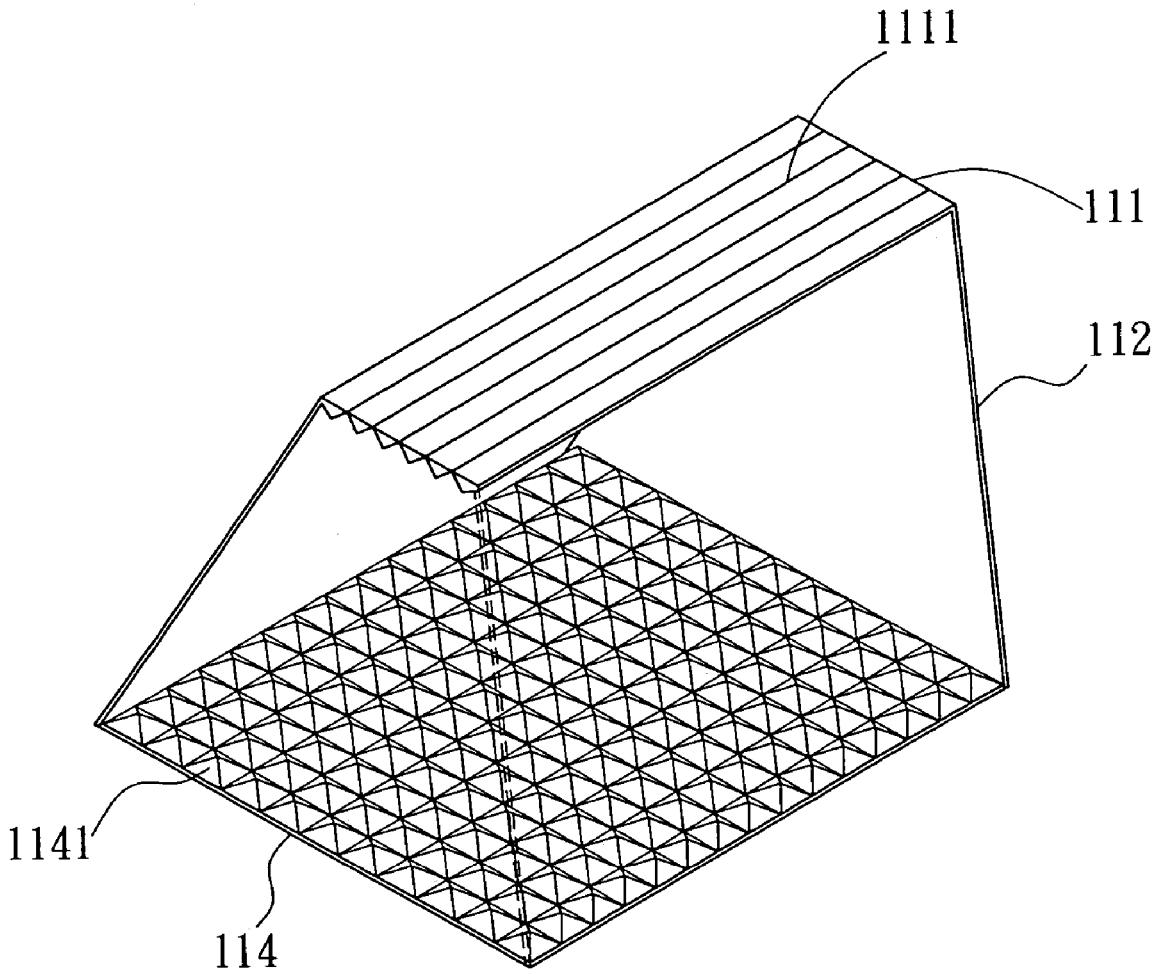
FIG. 11 is a 3D diagram showing a plate with microstructures disposed thereon according to the present invention.

Please refer to FIG. 11, which is a 3D diagram showing a plate 114 with microstructures 1141 disposed thereon according to the present invention, the plate 114 being arranged at the lower portion of a luminaire screen consisting of a planar reflector 111 and a side screen and being beneath a light source. As seen in FIG. 11, the plate 114 has a plurality of sawtooth-like microstructures disposed thereon and the planar reflector 111 has a plurality of bar-like microstructures 1111 disposed thereon.

Figure 12:
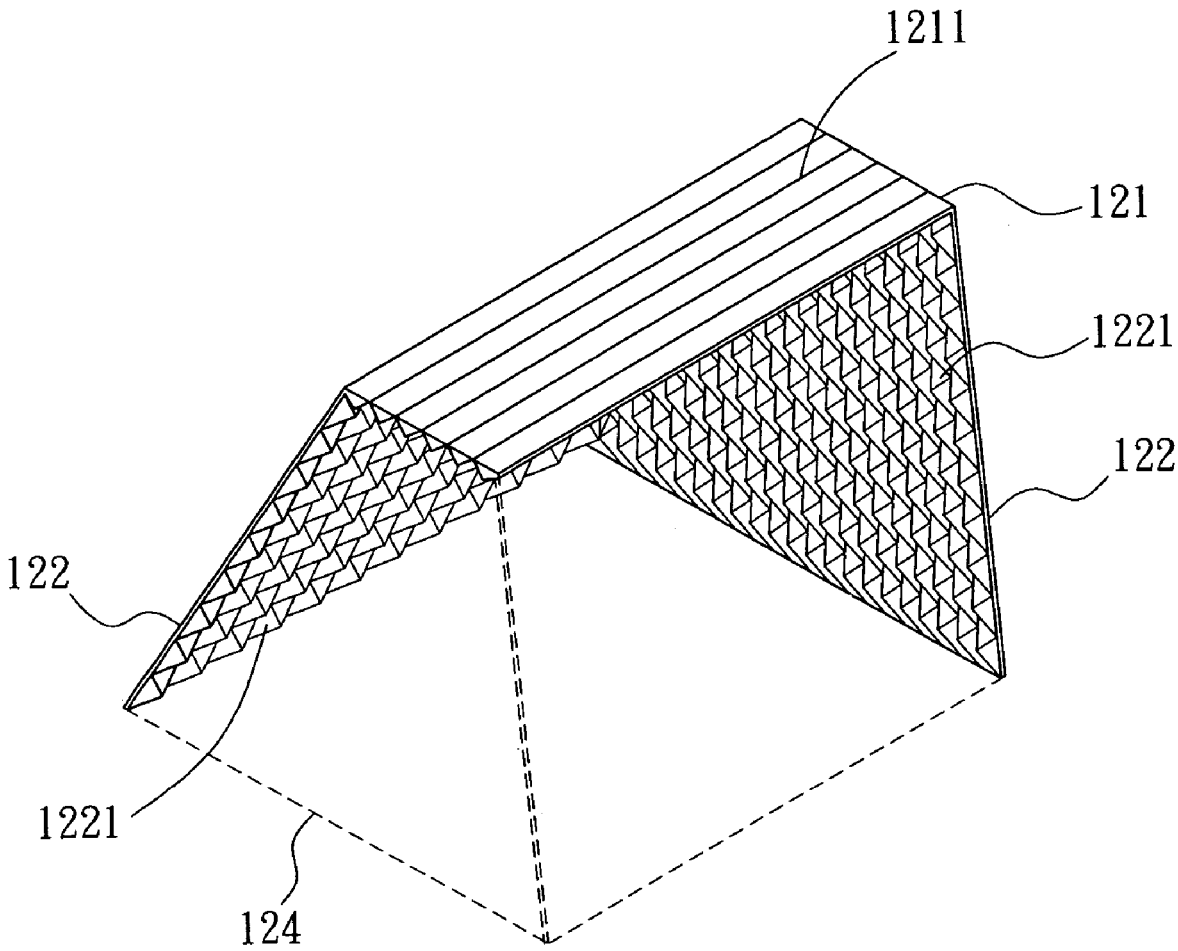
FIG. 12 is a 3D diagram showing the side screen with microstructures arranged thereon according to the present invention.

Please refer to FIG. 12, which is a 3D diagram showing a luminaire screen with side screen 122 having a plurality of microstructures 1221 arranged thereon according to the present invention, the luminaire screen further comprising a planar reflector 121 and a plate 124. As seen in FIG. 12, the side screen 122 has a plurality of sawtooth-like microstructures 1221 disposed thereon and the planar reflector 121 has a plurality of bar-like microstructures 1211 disposed thereon.

To sum up, the present invention provides a luminaire with reflector of negative focal length which comprises a light source and a luminaire screen having a reflector of negative focal length, a side screen and a plate. Wherein the rays emitting from the light source is divided by three area: a upward incident area including the rays incident to the reflector of negative focal length; a sideward incident area including rays incident to the side screen; and a downward incident area including rays incident to the plate; and the light source is a lighting means selected from the group consisting of a means of single light source, a means of multiple light sources. The reflector of negative focal length is capable of reflecting the rays of upward incident area which can be a planar lens of negative focal length and is selected from the group consisting of a reflector of multiple focal points and a reflector of signal focal point. The side screen is capable of reflecting the ray of the sideward incident area and the reflected rays of the reflector which has a plurality of microstructures arranged on the surface thereof, wherein each microstructures can be a diffuse point of a shape selected from the group consisting of diamond, sphere, column, and irregular shapes and is disposed by a manner selected from the group consisting of apart from one another by an equal interval and apart from one another by different intervals so as to regulate the amount of rays discharging from the side screen. The plate being disposed at the lower portion of the luminaire screen beneath the light source has optionally a plurality of microstructures arranged thereon and is capable of accepting the rays of the downward incident area along with both the reflected rays of the reflector and the side screen so as to diffuse the same for discharging, wherein each microstructures can be a diffuse point of a shape selected from the group consisting of diamond, sphere, column, and irregular shapes and is disposed by a manner selected from the group consisting of apart from one another by an equal interval and apart from one another by different intervals so as to regulate the amount of rays discharging from the plate. Moreover, in a preferred embodiment, a metal reflective surface with reflective index ranged between 0 and 1 is further attached onto the surfaces of both the reflector and the side screen and the plate is made of a material selected from the group consisting of Polycarbonate (PC), Polymethylmethacrylate (PMMA), and Polyethylene Terephthalate (PET).

In a preferred embodiment, the reflector of negative focal length of a luminaire screen, which can be a planar reflector, is used for reflecting the rays of the upward incident area and thus to increase the times of the same to be reflected inside the luminaire screen, and eventually, for enabling the luminaire to have larger discharging angle and better distribution of luminance. In addition, the disposition of a plate at the lower portion of the luminaire screen beneath the light source enables the luminaire to have more evenly distributed discharging light so that the phenomenon of glare can be reduced and the luminaire is ensured to have the light intensity profile as shown in FIG. 8 while the height of the luminaire can be reduced.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A luminaire with reflector of negative focal length, comprising: a light source and a luminaire screen having a reflector of negative focal length, and a side screen, wherein the reflector of negative focal length is capable of reflecting the upward-incident rays emitting from the light source, and the side screen is capable of accepting the sideward-incident rays emitting from the light source and the reflected rays of the reflector for reflecting the same, wherein the luminaire is configured to evenly emit light directly from the side screen.

2. The luminaire of claim 1, wherein the overall shape of the luminaire is selected from the group consisting of a symmetric shape and an asymmetric shape with respect to the characteristics of the light source, and a metal reflective surface with reflective index ranged between 0 and 1 is attached onto the surfaces of both the reflector and the side screen.

3. The luminaire of claim 1, wherein the reflector of negative focal length is made of a negative lens selected from a group consisting of a symmetric lens and an asymmetric lens.

4. The luminaire of claim 1, wherein the reflector of negative focal length is selected from the group consisting of a reflector of multiple focal points and a reflector of single focal point.

5. The luminaire of claim 1, wherein the side screen further comprises a plurality of microstructures arranged on the surface thereof, each microstructure being a diffuse point of a shape selected from the group consisting of diamond, sphere, column, and irregular shapes.

6. The luminaire of claim 1, wherein the light source is a lighting means selected from the group consisting of a means of single light source, a means of multiple light sources; and the light source is selected from the group consisting of point light sources and bar light sources, the point light source being selected from the group consisting of high intensity discharge (HID) lamps and light emitting diodes (LED) the bar light source being selected from the group consisting of cold cathode fluorescent lamps (CCFL) and fluorescent lamps.

7. The luminaire of claim 1, wherein the reflector is a curved reflector.

8. The luminaire of claim 1, further comprising a plate with a plurality of microstructures disposed thereon, being disposed at the lower portion of the luminaire screen beneath the light source, capable of accepting the downward-incident rays emitting from the light source along with both the reflected rays of the reflector and the side screen so as to diffuse the same for discharging.

9. The luminaire of claim 8, wherein the microstructures on the surface of the side screen are disposed by a manner selected from the group consisting of apart from one another by an equal interval and apart from one another by different intervals, so as to regulate the amount of rays discharging from the side screen.

10. The luminaire of claim 8, wherein the plural microstructures disposed on the surface of the plate are formed by a manner selected from the group consisting of integrally formed with the plate and doped the plate with micro particles.

11. The luminaire of claim 8, wherein the plural microstructures are disposed on the plate at a position selected from the group consisting of the top surface of the plate, the bottom surface of the plate, and both.

12. The luminaire of claim 8, wherein the plate is made of a material selected from the group consisting of Polycarbonate (PC), Polymethylmethacrylate (PMMA), and Polyethylene Terephthalate (PET).

13. The luminaire of claim 8, wherein each microstructure of the plate is a diffuse point of a shape selected from the group consisting of diamond, sphere, column, and irregular shapes.

14. The luminaire of claim 8, wherein the microstructures on the surface of the plate are disposed by a manner selected from the group consisting of apart from one another by an equal interval and apart from one another by different intervals, so as to regulate the amount of rays discharging from the plate.

15. The luminaire of claim 8, wherein the plate is a Fresnel lens for diffusing the incident rays thereon.

16. The luminaire of claim 8, wherein the reflector is a planar reflector.

* * * * *